United States Patent [19]

Clifford et al.

[11] 4,237,818

[45] Dec. 9, 1980

[54] MEANS FOR APPLYING TREATING LIQUOR TO TEXTILE SUBSTRATE

[75] Inventors: Graham F. Clifford, Stanley; Dieter F. Zeiffer, Iron Station, both of N.C.

[73] Assignee: Gaston County Dyeing Machine Company, Stanley, N.C.

[21] Appl. No.: 969,786

[22] Filed: Dec. 15, 1978

[51] Int. Cl.[3] ..... B05C 3/02; D06B 1/00; D06B 3/00

[52] U.S. Cl. ..... 118/410; 68/200; 68/175; 68/181 R; 68/205 R; 118/411; 118/415; 118/673; 118/688

[58] Field of Search ..... 118/410, 411, 415, 673, 118/688; 68/200, 205 R, 175, 181 R; 156/78, 79

[56] References Cited

U.S. PATENT DOCUMENTS

| | | | |
|---|---|---|---|
| 3,235,400 | 2/1966 | Voelker | 118/688 X |
| 4,023,526 | 5/1977 | Ashmas et al. | 427/244 X |
| 4,061,001 | 12/1977 | Eltz et al. | 118/413 X |
| 4,099,913 | 7/1978 | Walter et al. | 8/169 X |
| 4,159,355 | 6/1979 | Kaufman | 118/410 X |

FOREIGN PATENT DOCUMENTS 1075103 7/1967 United Kingdom .

*Primary Examiner*—Michael R. Lusignan
*Attorney, Agent, or Firm*—Richards, Shefte & Pinckney

[57] ABSTRACT

Treating liquor is applied to open-width textile substrate by pressure feeding the liquor in foamed condition to a distribution chamber having gently changing cross sectional areas and contours and arranged to deliver the foamed treating liquor evenly widthwise of the substrate through an application head past which the substrate is caused to travel under conditions that result in liquefying the foamed treating liquor in the course of application to the substrate.

21 Claims, 10 Drawing Figures

MEANS FOR APPLYING TREATING LIQUOR TO TEXTILE SUBSTRATE

BACKGROUND OF THE INVENTION

Much interesting work has heretofore been devoted to the application of foamed treating liquors to textile substrates. Good examples are disclosed in U.S. Pat. Nos. 4,023,526, 4,061,001, and 4,099,913. Problems have remained, however, in handling the treating liquor foam effectively during delivery to the substrate and in obtaining an even application of the foam to the substrate.

SUMMARY OF THE INVENTION

According to the present invention the foamed treating liquor is fed under pressure to a distribution chamber of gently changing contour and cross-sectional area with provision for draining from this chamber any foam decaying therein and for applying the foam delivered therefrom to a textile substrate caused to travel adjacently for such application in a manner which causes the foamed treating liquor to liquefy in the course of such application. The traveling textile substrate is held in proper position for the treating liquor application without requiring undue tension on the substrate for this purpose.

The resulting treating liquor application is effected with excellent evenness across the width of the substrate, and may be used to apply any desired treating chemical, such as soil or stain release agents, permanent press or wash and wear compositions, dyestuffs, hand builders, whitening agents, or the like, with substantial reductions in chemical costs due to more effective use of chemical and with material energy savings due to lessened wetting of the substrate.

DESCRIPTION OF THE PREFERRED EMBODIMENTS

Figure 1:
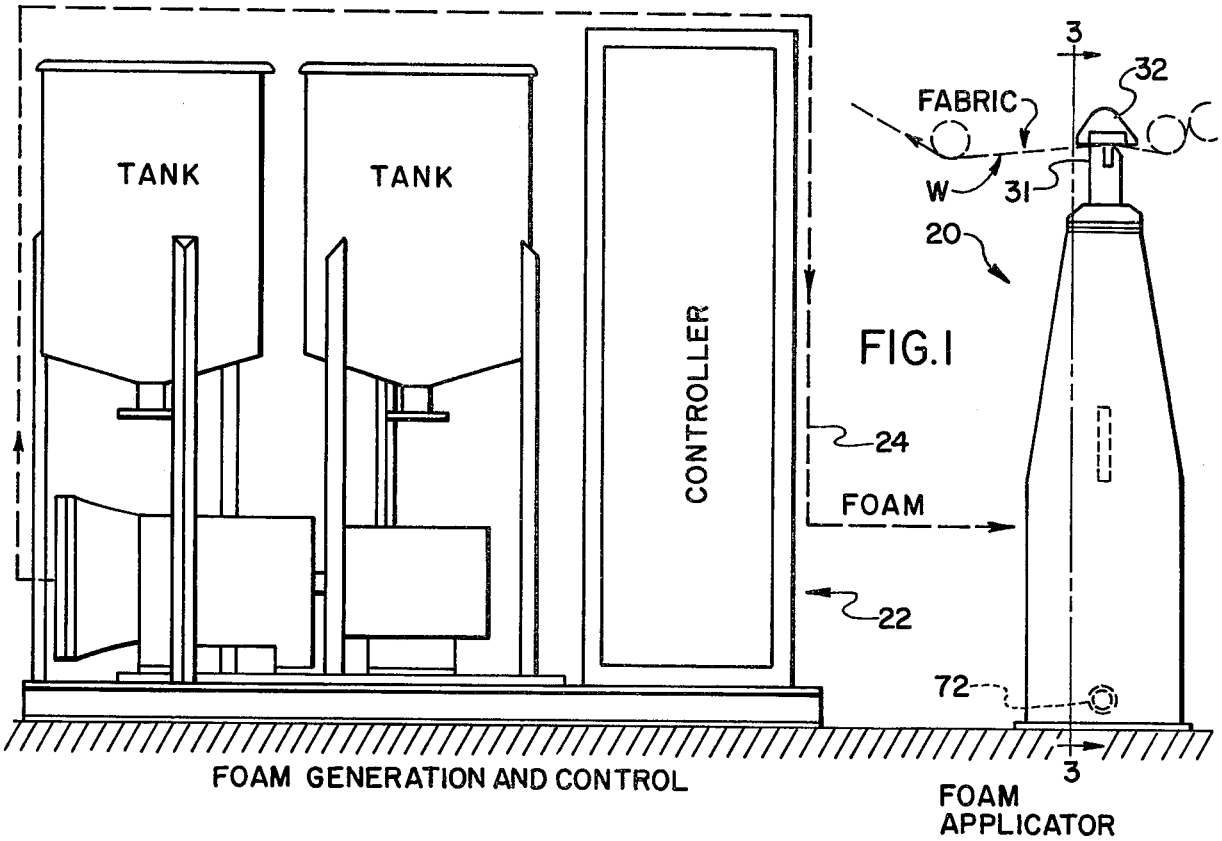
FIG. 1 is a front elevational view of a complete foam generation, control, and applicator apparatus embodying the present invention.

In the present invention, a foam distribution chamber and foam application head permit improved application of conventionally foamed treating liquor to an openwidth moving textile, or other, substrate under pressure. A complete foam applicator 20 is shown in FIG. 1 connected to a foam generation and control apparatus 22.

Figure 3:
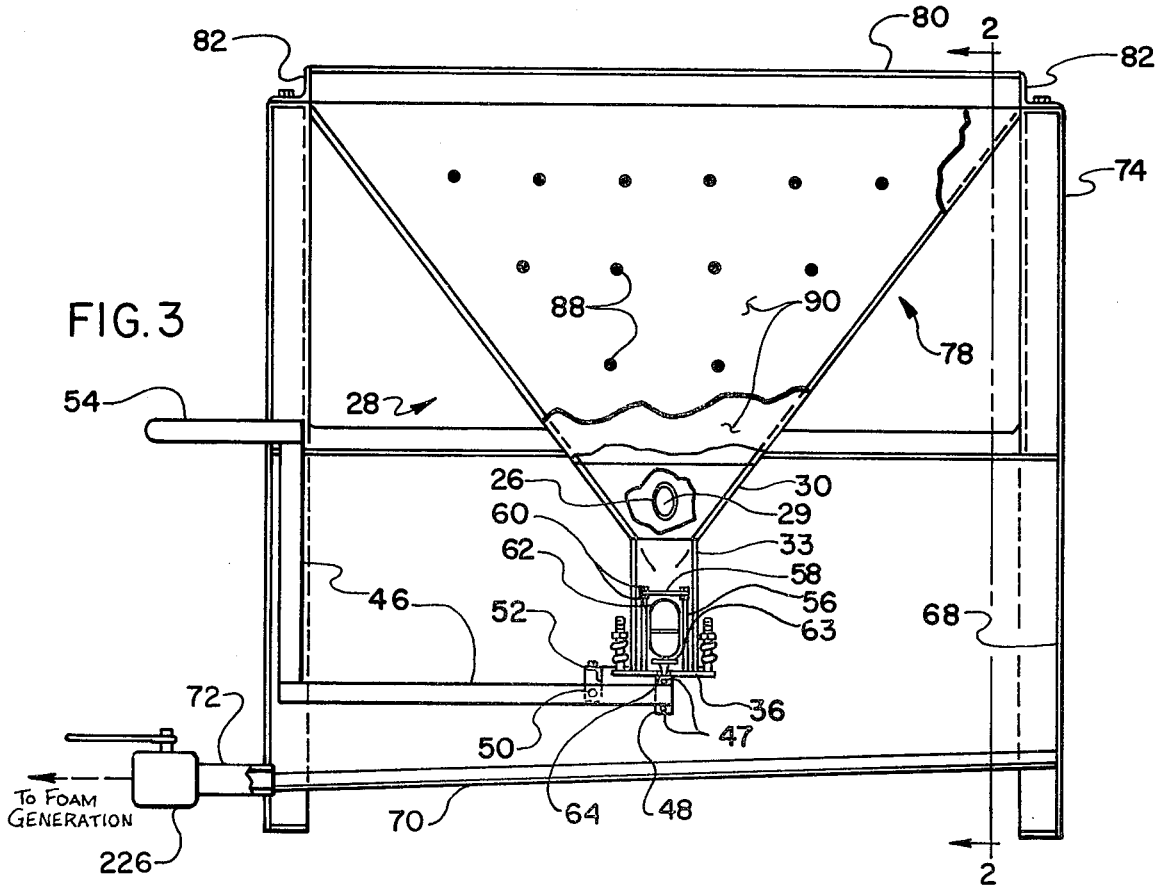
FIG. 3 is a partially broken-out cross-sectional view of the distribution portion of the applicator as taken generally along the line 3—3 of FIG. 1.
Figure 2:
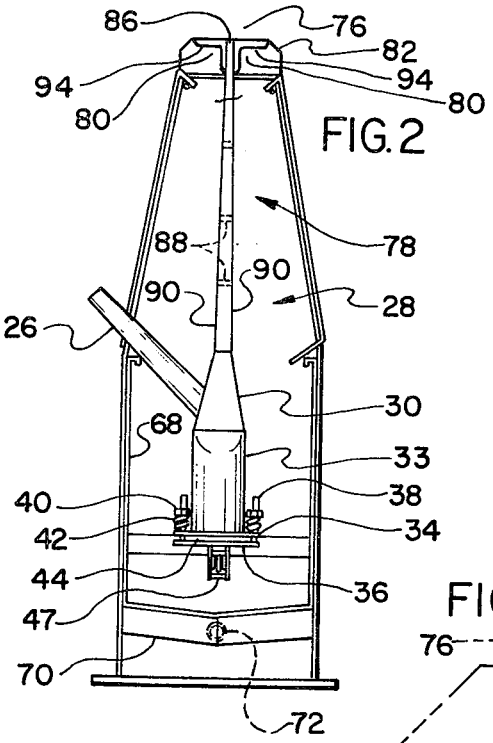
FIG. 2 is a cross-sectional view of the foam distribution portion of the applicator as taken generally along the line 2—2 of FIG. 3.

A conduit 24 extends in convenient form between the applicator 20 and the foam apparatus 22 and terminates in a downwardly extending inlet conduit portion 26 welded airtight to a foam distribution chamber 28 at an opening 29 in a hollow transition chamber section 30 thereof, as shown in FIGS. 2 and 3. The distribution chamber 28 extends continuingly upwardly to an application head portion 31 surmounted by a hold down device 32. A hollow initial foam collection chamber section 33 of the chamber 28 is located beneath the transition section 30 and is of generally compact cross-sectional shape, in this embodiment having a cylindrical lower portion which is formed to a generally square cross-sectional shape at its topmost portion for connection to a similar cross-sectional shape at the lowermost portion of the transition section 30. The transition section 30 is of increasing transverse width toward its top or uppermost portion relative to the open-width substrate W, and all portions of the application head 31 and distribution chamber 28 are preferably symmetrical and centered transversey with respect to the openwidth of the substrate to be treated. In general, all parts of the foam applicator 20 subject to contact with the treating liquor are constructed from stainless steel or other corrosion resistant material.

A flange 34 connected to the lower extremity of the initial section 33 supports a valve plate 36 disposed beneath the flange 34 by means of four studs 38 attached to the plate 36 and extending upwardly through mating holes (not shown) in the flange 34. Nuts 40 and springs 42 mounted on the upper portions of the studs 38 cooperate in supporting the plate 36 and adjustably biasing it upwardly toward the flange 34. A sealing gasket 44 is disposed between the flange 34 and the plate 36. A suitably shaped lever arm 46 extends between two cross pins 47 of a bracket 48 fixed to the underside of the valve plate 36, and is fulcrumed at a pin 50 fastened to a cross member 52 attached inside a tank described hereinafter. The lever arm 46 extends from pin 50 outwardly of the applicator 20 and terminates in a handle 54.

Figure 4:
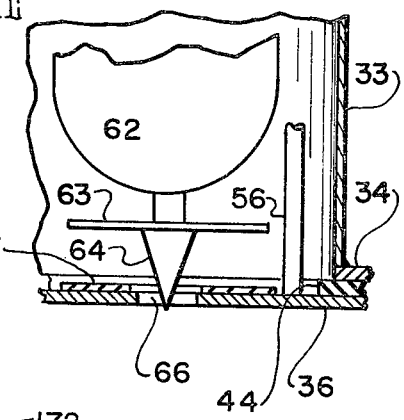
FIG. 4 is an enlarged portion of FIG. 3 showing details of the float, automatic drain valve, and valve plate of the distribution chamber.
Figure 9:
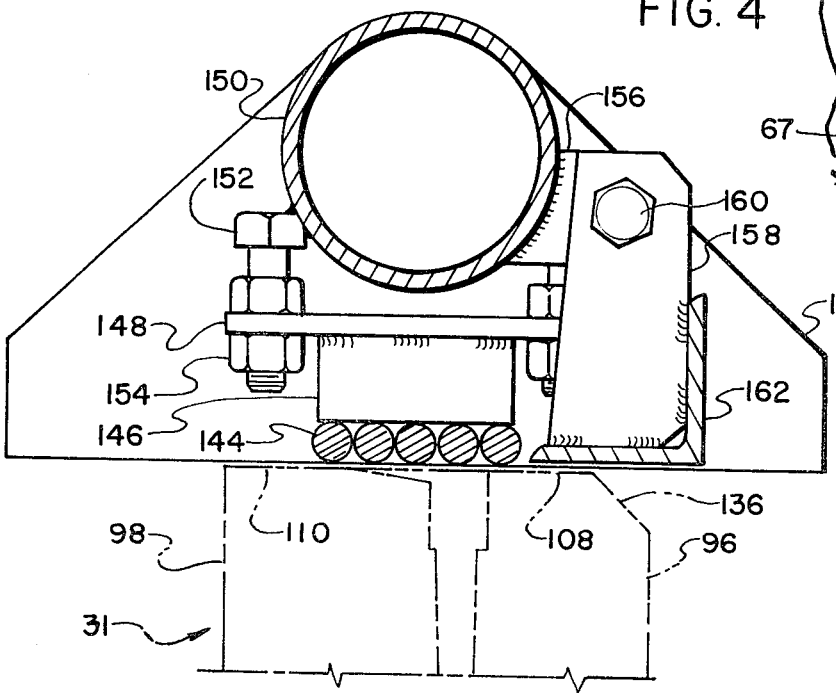
FIG. 9 is an enlarged cross-sectional view of the hold down device as taken along the line 9—9 of FIG. 7.

Four long studs 56 fixed to the valve plate 36 and extending upwardly therefrom are capped by a retaining plate 58 held in place by nuts 60 on the upper ends of the studs 56. The plates 36 and 58 and the studs 56 extending therebetween form a cage for retaining a hollow generally cylindrical float 62 therein. At the lower end of the float 62, as best shown in FIG. 4, a valve disc 63 is fastened between a conical member 64 and the float 62, and the conical member 64 extends point downwardly for normal disposition resting in a valve port hole 66 disposed centrally in the valve plate 36. The disc 63 normally rests flat atop a gasket 67 disposed on the valve plate 36 concentrically with the hole 66 to seal off the hole 66; however, in FIGS. 3 and 4, the float 62 is shown for clarity in its full floating, maximum upward position.

The initial and transition chamber sections 32 and 30 respectively are disposed within an open-topped tank 68 having a Vee-d inclined bottom portion and a drain pipe 72 at the lowermost portion thereof. The tank 68 is fastened into a frame structure 74 which supports at its top an angle iron terminal portion 76 of a continuing hollow section 78 of the foam distribution chamber 28. The terminal portion 76 includes two long angle irons 80 held paired in closely spaced parallel coextensive disposition as best shown in FIGS. 2 and 3, by two short angle irons 82, one of which is welded to said paired long angle irons 80 at each end of the pair. The space enclosed by the angle irons 80 and 82 forms a final passage 86 from the foam distribution chamber 28 and extends in length generally coextensively with the greatest open-width of the substrate to be treated by the applicator 20. The lower portion of the continuing section 78 is formed of stainless steel sheet extending between the top of the transition section 30 (matching the cross-sectional shape thereof) and the lowermost portions of the angle irons 80 and 82 (matching the cross-sectional shape of the passage 86) and is welded and sealed airtight at each end to the transition section 30 and the angle irons 80 and 82 respectively.

The transition section 30 is similarly welded to the initial section 33 at their connection, so that the foam distribution chamber 28 is normally airtight except through the conduit 24 and the passage 86. The various sections 30, 33, and 78 of the foam distribution chamber 28 have suitable cross-sectional shapes and areas so that foam may be distributed through gently changing cross-sectional areas and shapes from the compact circular and square cross-sections of the initial section 33, which are of limited transverse width relative to the transverse open-width of the substrate to be treated, to the long, narrow cross-sectional shape of the passage 86 as described hereinbefore. It is desirable that the distribution chamber 28 be free from abrupt changes in cross-sectional contour or area which tend to cause undue and irregular decay and deterioration of foam passing therethrough, and from pockets which may collect decayed foam in liquid treating liquor form and similarly cause undue and irregular deterioration and decay of foam. Spacers 88 of appropriate lengths are fastened between the opposing large flat walls 90 of the continuing section 78 to prevent "oil-canning" or flexing thereof which could cause undesirable decay of foam.

Figure 6:
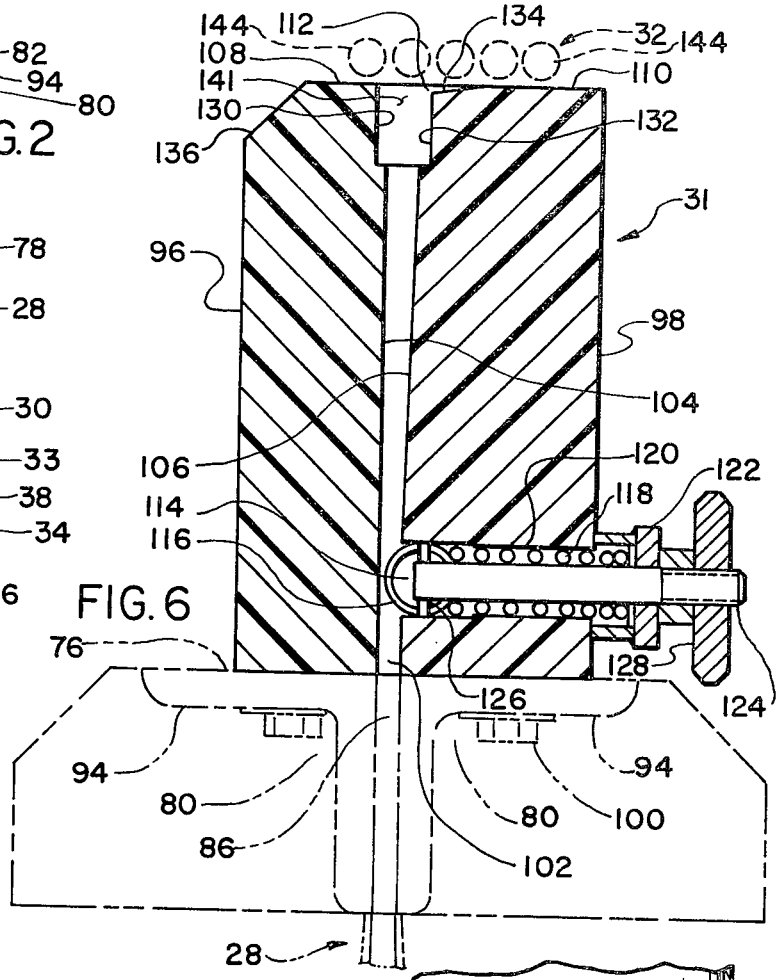
FIG. 6 is an enlarged cross-sectional view of the application head taken along the line 6—6 of FIG. 5.
Figure 5:
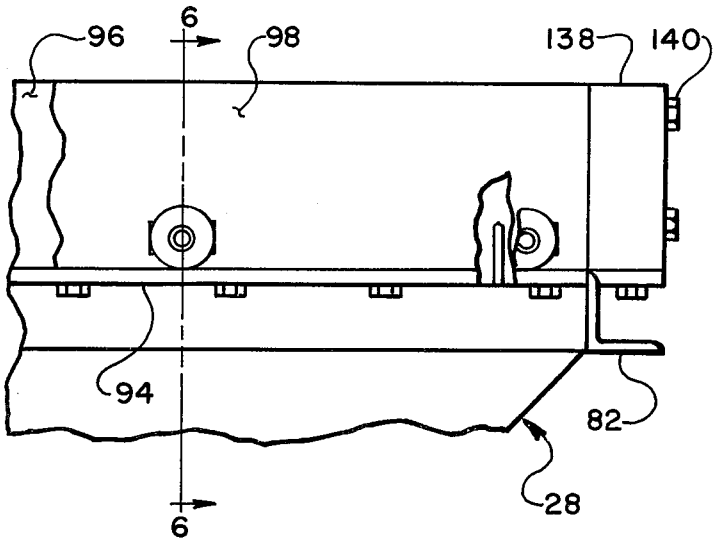
FIG. 5 is an enlarged left side view of the application head atop the distribution chamber taken also generally along the line 3—3 of FIG. 1.
Figure 5:
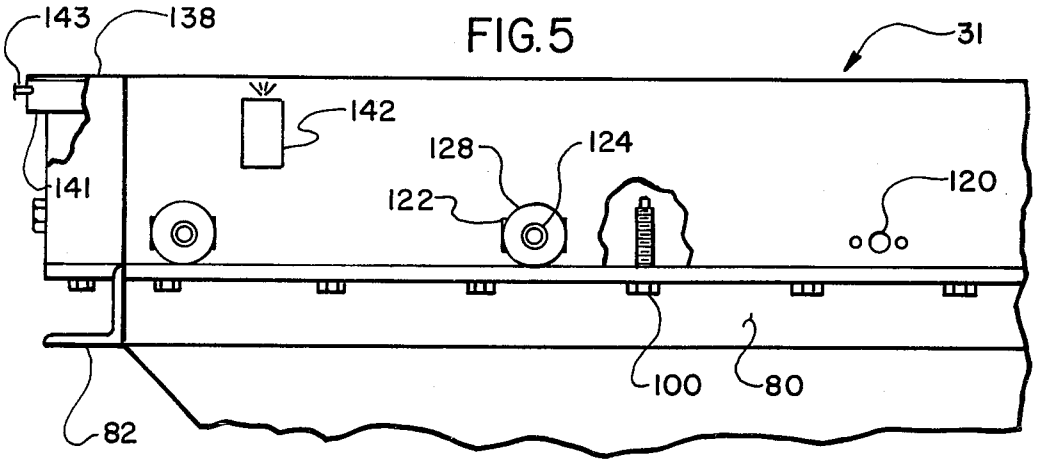
Figure 7:
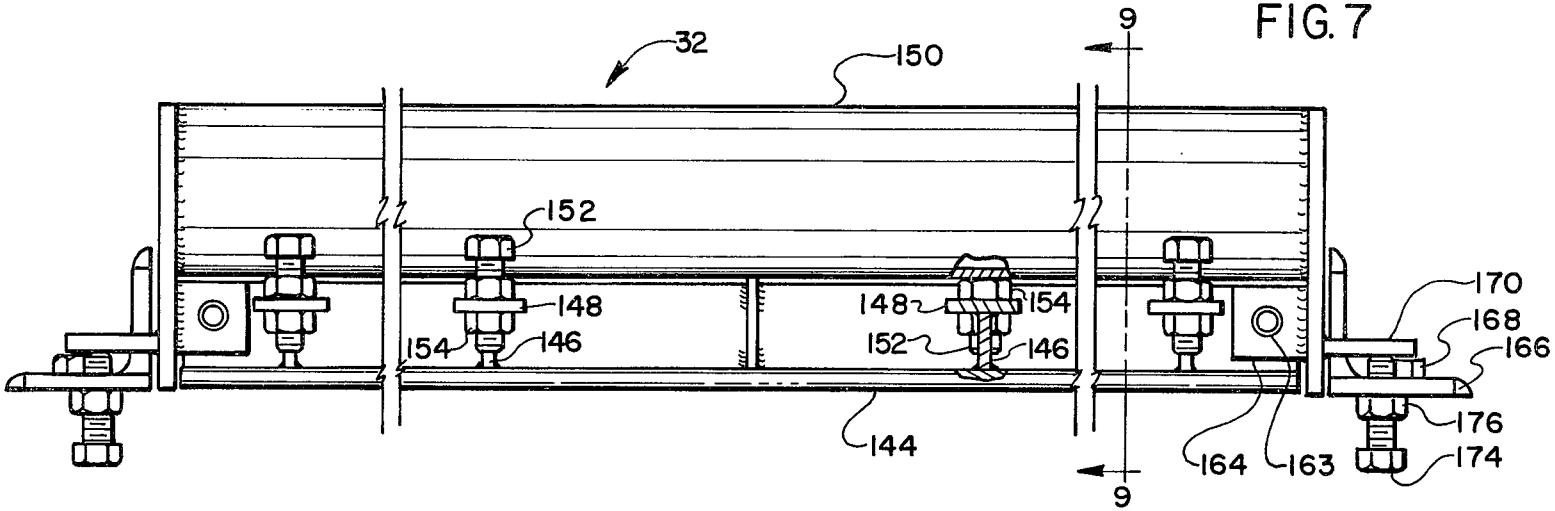
FIG. 7 is an enlarged left side view of the hold down device atop the application head also taken generally along the line 3—3 of FIG. 1.
Figure 8:
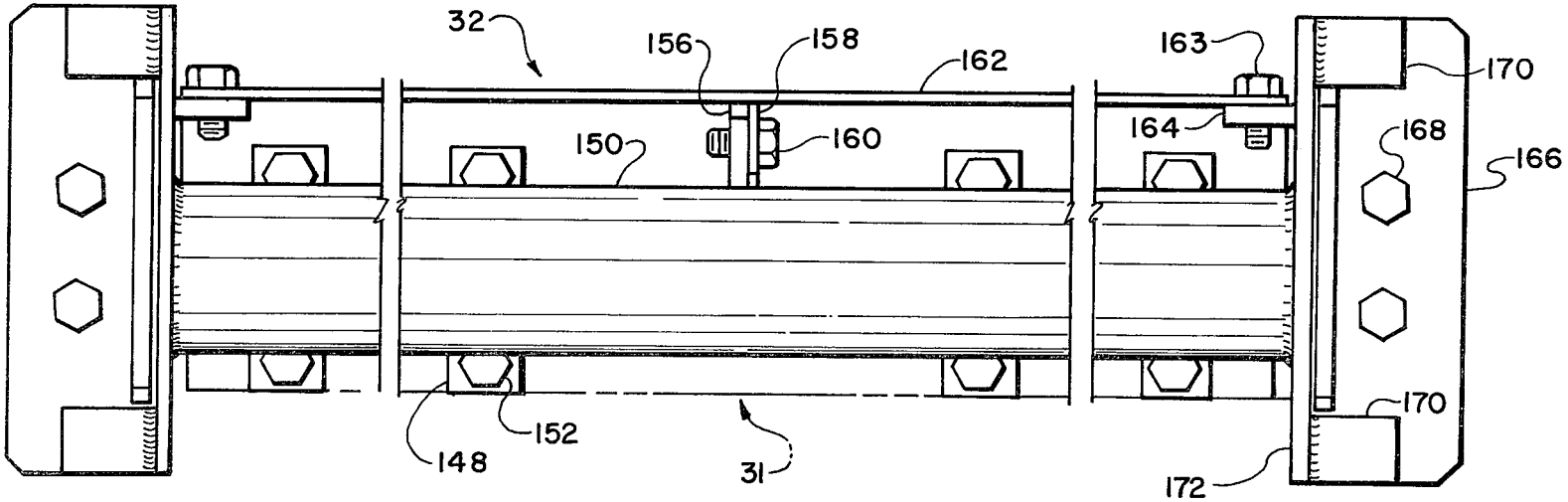
FIG. 8 is a plan view of the hold down device.

The application head 31 is disposed atop the horizontally extending legs 94 of the long angle irons 80, as best shown in FIGS. 5 and 6, and includes an entering side wall member 96 and a leaving side wall member 98 attached to the angle irons 80 by screws 100 passing through holes (not shown) in the angle iron legs 94 into threaded holes (not shown) in the undersides of the members 96 and 98. The members 96 and 98 are suitably formed from plastic materials such as "Plexiglass" and "Polyrite" respectively, the Plexiglass allowing visual observation of foam quality though not so wear resistant as Polyrite. The members 96 and 98 are generally co-extensive in length with the angle irons 80 and are preferably disposed parallel and spaced apart so that the application opening slot or space 102 between them matches, at the bottom thereof, the cross-sectional shape and area of the final passage 86 between the angle irons 80 and 82. The inner sides or lengthwise walls 104 and 106 of the members 96 and 98 respectively may be shaped to form any suitable slot or space 102, preferably continuous, therebetween, and to form an orifice 112 at the top of the slot 102 for passage of foam upwardly therethrough for application to a web W of textile or other substrate or fabric traversing the application head 31 and under the hold down device 32, as shown in FIG. 1. The length of the slot 102 generally corresponds to the open width of the substrate W and is disposed thereacross. The web W thereby passes over the top surfaces 108 and 110 respectively of members 96 and 98 as shown in FIG. 6. The shapes and cross-sectional areas of the slot 102 and the orifice 112 may be important to the even application of foamed treating liquor to the substrate W as disclosed in the previously mentioned U.S. Pat. No. 4,023,526, and may be varied to suit various conditions of substrate, treating liquor, foaming, et cetera according to the skill of the art, but the herein disclosed embodiment is a preferred one.

Excellent treating liquor application was obtained with the foam applicator 20 of the present invention when the inner side 104 of the entering side wall member 96 extended vertically for a substantial height of five and one-quarter inches above the corresponding coplanar inside surface of the final passage 86 of the foam distribution chamber 28, and when the inner side 106 of the leaving side wall member 98 extended vertically for about one and three-quarter inches above the opposite corresponding coplanar inside surface of the final passage 86, after which the side 106 diverges from a spacing of one-quarter inch from side 104 to a spacing of about three-eighths inch at the topmost extent of the side 104.

As best shown in FIG. 5, a groove 114 is sunk into the inner side 106 of the leaving side wall member 98 coextensively lengthwise thereof for slidable disposition of a tubular throttling member 116 coextensively therein for varying the effective width of the slot 102 selectively along its length. Multiple compression springs 118 contained within respective holes 120 (drilled from the outside of the side wall member 98 to the groove 114) bear against and bias the throttling member 116 for lateral protrusion thereof into the slot 102 to vary its width. The springs 118 are retained and compressed in the holes 120 by the caps 122 fastened thereover on the outside of the wall member 98. Threaded setting studs 124 have their plain ends inserted through holes in the caps 122, through the springs 118, and into lateral holes in the throttling member 116, and are secured by cross-pins 126 to the member 116, while the threaded ends thereof extend from the caps 122 for setting engagement by threaded hand knobs 128. Turning the knobs 128 causes the rounded side of the throttling member 116 to be selectively positioned to protrude more or less into the slot 102 at each spring 118 location therealong. The side wall members 96 and 98 have a height of six inches, and their inner sides 104 and 106 are such relieved for a distance of three-quarters of an inch from the top by vertical surfaces 130 and 132 respectively offset one-sixteenth inch toward the outside for a purpose to be explained hereinafter. At the intersection of the vertical surface 132 with the top surface 110 of the member 98, a foam-camming surface 134 inclined 5 deg. from horizontal extends upwardly toward the outside of member 98 for a horizontal distance of three-quarters of an inch. At the outside edge of the top surface 108 of the member 96 a web-seam-camming surface 136 forms a one-half inch by 45 deg. chamfer therealong.

The side wall members 96 and 98 are squared-off at their ends, and plastic blocks 138, as shown in FIG. 4, are fastened thereto with the screws 140 to form the ends of the slot 102. Elongated sealing members 141 have a cross-sectional shape as shown in FIG. 6, suitable for a sliding fit lengthwise of the orifice 112 formed by the vertical surfaces 130 and 132 and the foam-camming surface 134. Slots of corresponding cross-sectional shape are formed in the tops of the plastic blocks 138, and the sealing members 141 are of suitable length for sliding engagement in the slots and extension lengthwise into the slot 102 sufficiently to seal off the ends of the slot 102 to a variable length more closely corresponding to the open width of the web W being treated, sealing members 141 normally underlapping the edges of the web W slightly, or to any predetermined extent to which untreated substrate selvages are desired. Suitable photocell edge-location sensors 142 and air cylinder apparatus 143 controlled thereby may be connected to the sealing members 141 to cause them to be positioned automatically for underlapping to a predetermined extent the edges of the web W being traversed over the application head 31.

The hold-down means or device 32, as best shown in FIGS. 6–9, is disposed above the orifice 112 in opposing relation to the head 31 thereat for holding the web W being treated from rising up from the force of foam application and gas from the decaying foam escaping through the web W. Grid bars 144 of the hold-down device 32 form a platen generally coextensive with the orifice 112 of the slot 102 at the upper surfaces 108 and 110 of the head 31, the undersides of the grid bars presenting a limited area of contacting surface for the web W and providing open area therebetween for releasing the air from the foam. The grid bars extend across the application head 31 spaced slightly above the top surfaces 108 and 110 of the side wall members 96 and 98 to allow clearance therebetween for passage of the web or substrate W. The grid bars 144 are held in parallel spaced relation to each other by welded attachment to a number of spacer bars 146 which are in turn welded to support cross pieces 148. The cross pieces 148 are adjustably supported from and locked to a tubular crossbeam 150 by bolts 152 which are welded to the crossbeam 150, and nuts 154 on the bolts 152.

The crossbeam 150 has a number of ears 156 welded thereto and protruding therefrom for respective pivotable connection to pivot brackets 158 by means of pivot bolts 160. The brackets 158 are in turn welded to and intermediately support an angle stretcher beam 162 which is supported at its end by screws 163 threaded into tabs 164 welded to a pair of headers 172 which are welded to the ends of the crossbeam 150. A pair of support angles 166 are supported on the tops of the plastic blocks 138 at the ends of the application head 31 and attached thereto by screws 168. The crossbeam 150 is adjustably supported in operating position by a pair of spaced support ears 170 welded to each of the headers 172. Adjustable support screws 174 mounted at the ends of the support angles 166 bear against the undersides of the support ears 170 for accurate vertical positioning of the crossbeam 170 and thereby the grid bars 144, for operation, and the screws are locked in place by the nuts 176. The spaced support ears 170 at each header 172 straddle the corresponding support angle 166 and retain the crossbeam 150 and attached grid bars 144 from horizontal lateral movement, yet permit upward movement thereof, while the angles 166 restrain lengthwise movement thereof.

Figure 10:
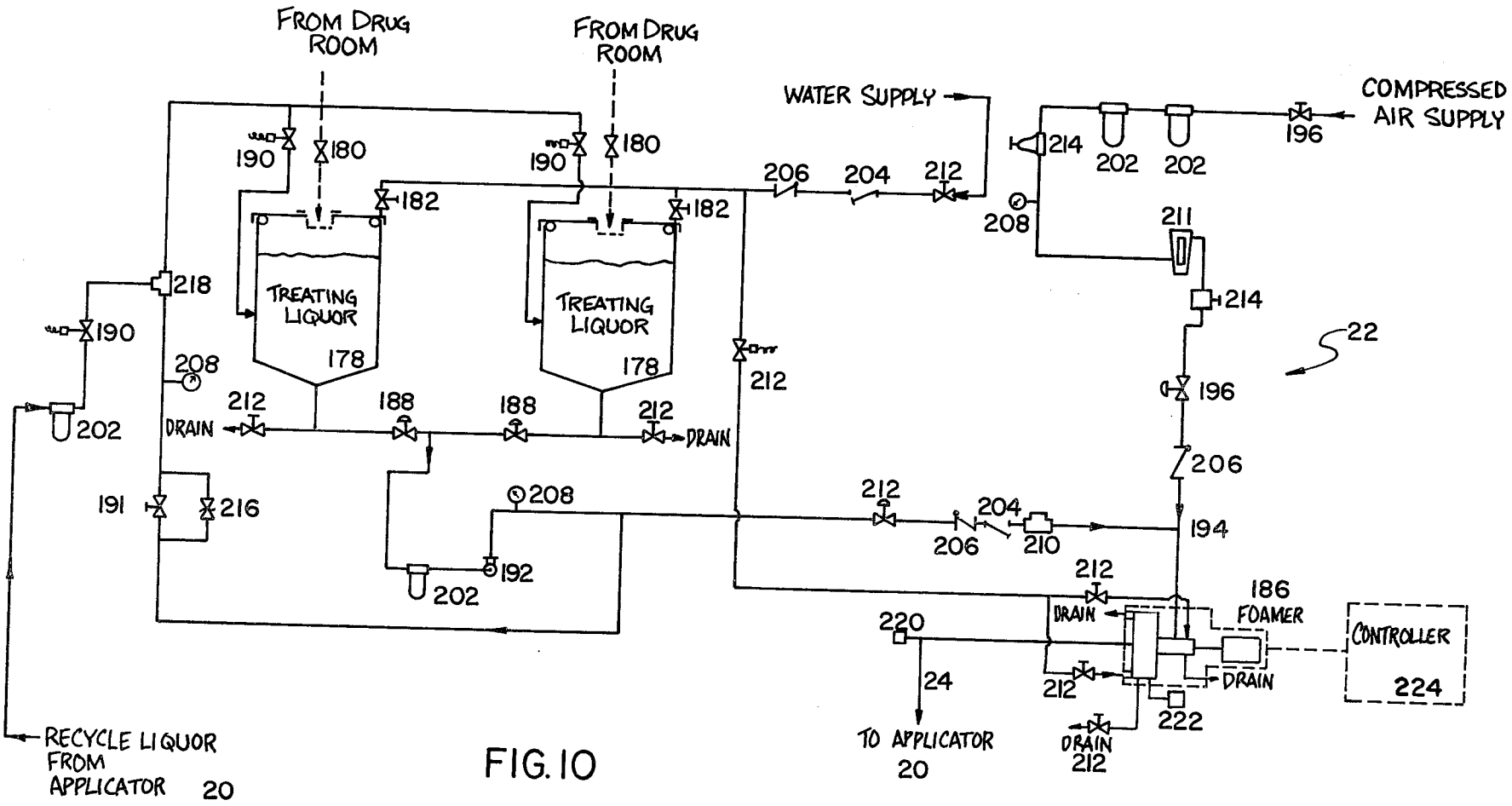
FIG. 10 is a schematic circuit diagram of the foam generation and control apparatus.

The foam generation and control apparatus 22 shown in FIG. 1 is shown schematically in greater detail in FIG. 10, where two 50 gallon tanks 178 are supplied with chemicals through valves 180 connected between the tanks and a drug room (not shown), and with water through valves 182 connected to a water supply (not shown), to form suitable foamable treating liquor therein. The treating liquor may be selectively fed from the tanks 178 to the foamer unit 186 through valves 188 connected thereamong. Treating liquor may be recirculated from the tanks 178 and recycled from the foam applicator 20 back to the tanks 178 by means of the valves 190 connected therebetween, and a needle valve 191 provides regulation for a continuing recirculation. A gear pump 192 pumps the treating liquor for the above-mentioned feeding, recirculating, and recycling.

Compressed air from a supply not shown is admitted to a junction 194, for mixing with the treating liquor being fed to the foamer 186, through the valves 196 which are connected between the air supply and the junction 194. The foamer 186 receives the mixed treating liquor and compressed air, and, operating at a preset speed, foams the liquor to a suitable consistency, and forces the foamed liquor through the conduit 24 to the foam applicator 20 at a constant rate.

Suitable filters 202 and strainers 204 are appropriately placed in the liquor, water, and air lines connecting the various elements of the foam apparatus 22, as are check valves 206, pressure gages 208, flow meters 210 and 211, and additional valves 212. Pressure regulators 214 are provided in the compressed air line, and a relief valve 216 and an eductor 218 for recycling liquor from the applicator are provided in the line for recirculating liquor from the tanks 178 back thereto. A temperature transducer 220 monitors the foamed liquor leaving the paddle foamer 200, and a pressure transducer 222 monitors the pressure therein.

A controller unit 224 is shown in FIG. 10 connected symbolically to the foamer unit 186 by a broken line symbolizing the physical connections between the controller 224 and the various controlled, controlling, and monitoring elements of the foam apparatus 22 such as the solenoid valves (those having curlicue symbols on their stems), the pump, the foamer, the flowmeters, and the transducers. The controller 224 maintains a very closely controlled and essentially constant preset volumetric flow of treating liquor to the foamer unit 166 under a pressure of about 40 psi by suitably varying the speed of the pump 192 in response to signals from the flowmeter 210 which monitors said volumetric flow in the treating liquor circuit. The controller 224 also provides remote control for the solenoid valves. The flowmeter 211 in the air supply line operates automatically to maintain a suitably constant preset flow rate of air into the system, though the air supply is not so critical as the liquor supply, and there is no feedback from the air flowmeter to the controller 224. The temperature transducer 220 monitors foam temperature after the foam passes through a cooling jacket (not shown) for prevention of undesirable high temperatures when light applications of foam are being made.

In operation, after suitable presettings have been made to the foam generation and control apparatus 22, the apparatus 22 is operated until the character of the foam produced (and forced through the conduit 24 to the chamber 28) has stabilized while the lever arm 46 is held up to open the valve plate 36, thereby allowing the foam produced to flow into the tank 68 for decay and drainage back to the foam apparatus 22 for recycling. Thereafter, the arm 46 is lowered to close the valve plate 36, and a constant supply of foamed liquor from the foamer unit 186 is fed under pressure through the conduit 24 and is forced from the downwardly extending conduit portion 26 into the adjacent initial chamber section 33 of the foam distribution chamber 28, filling the initial section 33 and then rising to fill the distribution chamber 28 and feed to and through the application head 31 to the orifice 112 thereof for application to the substrate W traversing the orifice 112. Forcing the foam initially downwardly into the initial chamber section 33 assures that any decaying foam collects there for automatic draining therefrom. The conduit portion 26 need not extend downwardly, but should preferably be disposed to feed foamed liquor to the chamber 28 symmetrically with respect to the open width of the substrate and in such manner that the heavier components of the foam will have a chance to collect in the initial section 33 and will not be carried to one side or the other of the chamber 28. Guides or baffles (not shown) could also be used adjacent the discharge end of conduit portion 26 to assure such collection and symmetrical feed of foam to initial section 33, thereby assuring that uniform and fresh foam is always rising therefrom, and the valve plate 36 may be opened at any time to discharge the foam from the initial section 33 for recovery and recycling whenever substrate application is not desired. The foamed liquor (in compressed form) remains under pressure typically on the order of 6 inches of water column, until the instant of application to the substrate W, at which instant the liquor forming the bubble films of the foam is blown through the substrate for absorption therethrough by the rapidly expanding air released from the bubbles into the substrate for passage therethrough to the surrounding atmosphere at atmospheric pressure. The resistance of the substrate W to the passage of air therethrough prevents the pressure within the distribution chamber 28 and the application head 31 from dissipating or varying appreciably therein and causes approximately the aforementioned 6 inches of pressure to be maintained so long as sufficient foam is supplied to the substrate W, though differences in porosity of the substrate W may cause minor differences in the pressure which may cause the foam to expand or contract, yet continue to fill the distribution chamber 28, without disturbing the even application of treating liquor to the substrate. Since the volumetric flow of treating liquor is maintained constant to and from the foamer unit 186 by the flowmeter 210 and the controller 224, a drop in pressure in the chamber 28 due to greater porosity of the substrate W will cause the foam in the chamber 28 to expand so that increased volumetric flow of foam to the substrate will still cause application of treating liquor to the substrate at the same constant rate at which it flows from the foamer unit 186, and vice versa for lesser porosity in the substrate. The means of the present invention therefore provides a constant rate of application of treating liquor to substrate independently of the porosity of the substrate and of variations in pressure within the foam distribution conduits and chambers following the foamer unit, once equilibrium conditions have been established as described in U.S. Pat. No. 4,023,526.

It is the sudden expansion of the air bubbles from the decaying foam, even as the foam is destroyed by the sudden absorption of its liquor into the substrate W, which seems to cause a very even and penetrating application of the liquor to the substrate. Since the liquor pickup by the substrate may typically be only 10% of the weight of the substrate, the result is a treated substrate which is practically dry. Suitable settings of liquor flow rate, foam density, and substrate traverse speed may be used to achieve one-side treatment or whatever desired penetration of the substrate.

Since the penetration and absorption of the treating liquor must be balanced by the quantity of treating liquor supplied to each unit area of the moving substrate W, it is essential that equal quantities of treating liquor be delivered at each unit area of the cross-section of the orifice 112 of the application head 31. This uniformity is achieved by the hereinbefore described construction of the foam distribution chamber 28 and the application head 31 wherein both elements are symmetrical and transversely centered with respect to the open-width of the substrate being treated, the transition from the compact cross-sectional area of the initial chamber section 32 of the chamber 28 to the cross-sectional area of the long, narrow orifice 112 of the application head 21 is gentle in shape, contour, and area changes, and the foamed liquor moves ever upwardly from the initial section 32 to the orifice 112 so that any treating liquor in liquid form (resulting from foam decaying in transit) will drain back freely, collecting in the initial section 32 where its accumulation will cause the float 62 to rise and thereby open the valve port hole 66 for automatic drainage of the decayed foam from the chamber 28 into the tank 68. From the tank 68 the decayed foam flows through the drain pipe 72 and an associated valve 226 through a suitable conduit toward the eductor 218 which pulls the decayed foam for recycling back into the recirculating liquor flowing from the pump 192 back to the tanks 178.

Thus, the foam travels essentially uniformly and undisturbed through the distribution chamber 28 so that all the foam is of essentially the same density, bubble size, and treating liquor content when presented to the application head 31. Any variations in uniformity of the flow through the slot 102 or orifice 112 along the length thereof which would cause non-uniformity of treating liquor distribution or application across the width of the substrate W may be adjusted out by selective variation therealong of the passage of foam by manipulating the hand knobs 128 for suitable protrusion of the throttling member 116 into the slot 102, the member 116 being suitably flexible to accommodate any required curvature. A throttling member could be disposed across the width of the chamber 28 or elsewhere with respect to the slot 102 for similar effect.

The substrate W is shown in FIG. 1 deflected downwardly on both sides of the application head 31, and by exerting sufficient tension in the moving web of substrate W it is possible to keep the substrate in uniform contact with the upper surfaces 108 and 110 of the head 31 against the pressure of the foam within the head 31. However, such tension may cause lengthwise stretching and consequent widthwise shrinking of the substrate W, subsequently requiring a further operation to restore the substrate to its natural shape. Therefore, the hold down device 32 is mounted atop the head 31 for holding the substrate independently of tension therein in uniform disposition to the upper surfaces 108 and 110 of the head 31, closely proximate thereto for free traverse therepast without undue tension in the substrate, while providing open spaces between the grid bars 144 for releasing the air incident to the application of the foamed treating liquor to the substrate and the resulting decay of the foam. The air is thus released generally through the thickness of the substrate, perpendicularly to the flatwise extent thereof. If treating liquor should be forced completely through the substrate W to appear and form bubbles in the open spaces between the grid bars 144, then the cylindrically shaped under surfaces of the grid bars 144 will act as cam surfaces to force or work the treating liquor back into the substrate W during its traverse past the grid bars. Free-turning or powered rollers (not shown) could be substituted for the grid bars 144 with similar effect. A single large foraminous surfaced roller (not shown) might be substituted for the grid bars 144 to perform similar holding and air releasing functions. Alternatively, where the substrate being treated is comparatively thick, such as carpeting or other heavy fabrics, it may be preferable to substitute a solid flat bar or roller (not shown) to occupy generally the same position as the grid bars 144 of the hold down device 32, thereby forming a platen presenting a continuous contacting surface to the substrate for causing the air releasing from the decaying foamed treating liquor to occur in flatwise direction of the substrate.

Since seams or other anomalies in the thickness of the substrate W will periodically pass between the hold down device 32 and the application head 31, the cross-beam 150 and the grid bars 144 mounted therefrom are free to move upwardly as previously described when such an anomaly enters between the web-seam-camming surface 136 and the under flange of the angle stretcher beam 162, thereby moving the grid bars upward out of harm's way until the anomaly has traversed past. Though the hold down device 32 is a rigid and heavy structure, its weight per inch of length is not so great but what it is easily nudged upwardly by seams. Any non-uniformity of treating liquor application upon such an occurrence is of no importance, since the anomaly is a defect in the substrate.

While the hold down device 32 as illustrated in the drawings is a preferred embodiment, exemplary alternatives within the scope of the appended claims might include one or more additional application heads and foam distribution chambers either directly opposed to the application head 31 or in staggered relation along the path of travel of the substrate W. Substrate W need not travel horizontally, but may be in any disposition, such as vertical, for example, with one or more application heads passing foam horizontally or otherwise to the substrate, and such adaptations are well within the ability of those skilled in the art. Application heads need not be of the configuration of head 31, but, for example, may be more or less complicated, depending on the treating requirements, and, particularly for light treating liquor applications, the application opening slot portion may need to be no more than the widespread open end of a distribution chamber similar to chamber 28. The throttling means could be at the point of application of foam to substrate, thereby not only controlling the passage of foam through the application slot to the substrate, but also selectively controlling along the length of the slot the time during which the moving substrate is in contact with the foam, an important factor as explained in U.S. Pat. No. 4,023,526.

Once the suitable presettings of treating liquor quantity, compressed air quantity, and foamer speed have been made in accordance with the character of the treating liquor and of the substrate W being treated and its traverse speed with relation to the width of the orifice 112 of the application head 31, then the system will operate stably to apply the treating liquor very uniformly and consistently to the substrate. The mechanics of the relations of the above-mentioned quantities and speeds and characteristics are disclosed in the aforementioned U.S. Pat. Nos. 4,023,526 and 4,099,913 and require no further explanation here. However, the foam applicator head disclosed in U.S. Pat. No. 4,023,526 has been found inadequate for commercial purposes and the foam applicator apparatus 20 of the present invention provides means of commercially practicing the methods disclosed in the just-mentioned patents with superior and acceptable uniformity of treatment, particularly in the case of typical substrates of 50" to 72" open-widths.

The present invention has been described in detail above and disclosed in the drawings for purposes of illustration only and is not intended to be limited by this description or otherwise to exclude any variation or equivalent arrangement that would be apparent from, or reasonably suggested by, the foregoing disclosure to the skill of the art, the scope of this invention being limited only by the scope of the appended claims.

We claim:

1. Means for applying foamed treating liquor under pressure to open-width moving textile substrate comprising:

a foam distribution chamber having an inlet conduit for foam, an application opening slot portion disposed to extend across the width of said substrate in close proximity thereto for traverse thereby, and means for distribution of foam from said inlet conduit to said application opening slot portion of said distribution chamber in essentially uniform foamed condition comprising a portion of said chamber continuing from said inlet conduit, said continuing portion being of limited widthwise extent with respect to the open width of said substrate adjacent said inlet conduit, extending from said conduit to generally match with said slot portion, and having cross-sectional shape only gently changing therebetween.

2. Means for applying treating liquor to substrate as defined in claim 1 and characterized further by means for selectively varying along said application opening slot portion said distribution of said foam in said uniformly foamed condition thereto.

3. Means for applying treating liquor to substrate as defined in claim 2 and characterized further by means for collecting and draining decayed foam from said distribution chamber automatically.

4. Means for applying treating liquor to substrate as defined in claim 1 and characterized further by means for collecting and draining decayed foam from said distribution chamber automatically.

5. Means for applying foamed treating liquor under pressure to porous open-width moving textile substrate including a foam distribution chamber having an inlet conduit for foam, an application opening slot portion disposed to extend across the width of said substrate in close proximity thereto for traverse thereby, and means for distribution of foam from said inlet conduit to said application opening slot portion of said distribution chamber in essentially uniform foamed condition comprising a portion of said chamber continuing from said inlet conduit for passage of said foamed liquor therethrough, said slot portion having a suitable width adjacent said substrate in the direction of movement thereof for said applying treating liquor to said substrate in even fashion, wherein the improvement comprises means disposed opposite said application portion for holding said moving substrate independently of tension therein in suitably uniform disposition to said application portion during said traverse thereat and for releasing air thereat through said substrate incident to application of said foamed treating liquor, said holding and releasing means comprising a platen generally coextensive with the cross-sectional area of said slot adjacent said substrate, said platen presenting a limited area of contacting surface suitably disposed to said substrate for maintaining said uniform disposition to said application portion and a suitable open area suitably disposed to said substrate for said releasing air thereat through the thickness of said substrate generally perpendicular to the flatwise extent of said substrate, and said platen being suitably shaped adjacent said contacting surface area for working back into said substrate any foam appearing on said substrate within said open area.

6. Means for applying treating liquor to open-width moving substrate as defined in claim 1 wherein said substrate is porous, said application portion includes a slot for passage of said foamed liquor therethrough having a suitable width adjacent said substrate in the direction of movement thereof for said applying treating liquor to said substrate in even fashion, and holding and releasing means is provided comprising means generally coextensive with and opposite the cross-sectional area of said slot adjacent said substrate, said co-extensive means presenting a continuous contacting surface to said substrate for maintaining said moving substrate in uniform disposition to said application portion across the transverse width thereof and for causing air releasing incident to applying said foamed liquor to said substrate to occur through said substrate in flatwise direction thereof where said substrate being treated has sufficient thickness therefor.

7. Means for applying treating liquor to open-width moving substrate as defined in claim 1 or 5 wherein said application portion includes a slot for passage of said foamed liquor therethrough disposed for said traverse by said substrate, said slot having a length generally corresponding to the open width of said substrate and disposed thereacross, and sealing members slidable lengthwise of said slot for varying the length of said slot to more closely correspond to the open width of said substrate and seal off the ends of said slot by underlapping the edges of said substrate.

8. Means for applying foamed treating liquor under pressure to open-width moving substrate comprising:

(a) a foam distribution chamber having an inlet conduit for foam, an application opening slot portion disposed to extend across the width of said substrate in close proximity thereto for traverse thereby, and means for distribution of foam from said inlet conduit to said application opening slot portion of said distribution chamber in essentially uniform foamed condition comprising a portion of said chamber continuing from said inlet conduit, said continuing portion being of limited widthwise extent with respect to the open width of said substrate adjacent said inlet conduit, extending from said conduit to generally match with said slot portion, and having cross-sectional shape only gently changing therebetween; and (b) foaming apparatus for said treating liquor comprising a foamer, a source of said treating liquor, a variable delivery pump for pumping treating liquor in liquid form to said foamer, a flowmeter for monitoring the volumetric rate at which said liquid liquor is pumped to said foamer, a controller connected to said flowmeter and said pump for controlling the delivery of said pump to cause said pump to deliver said liquid liquor to said foamer at a predetermined constant volumetric rate, a source of compressed air, a regulating flowmeter for causing said compressed air to be delivered to said foamer at a predetermined constant volumetric rate, and a connecting conduit for transporting foam from said foamer to said inlet conduit of said foam distribution chamber.

9. Means for supplying foamed treating liquor at a constant rate for application under pressure to moving substrate comprising a foamer, a source of said treating liquor, a variable delivery pump for pumping treating liquor in liquid form to said foamer, a flowmeter for monitoring the volumetric rate at which said liquid liquor is pumped to said foamer, a controller connected to said flowmeter and said pump for controlling the delivery of said pump to cause said pump to deliver said liquid liquor to said foamer at a predetermined constant volumetric rate, a source of compressed air, a regulating flowmeter for causing said compressed air to be delivered to said foamer at a predetermined constant volumetric rate, and a connecting conduit for transporting foam from said foamer for said application.

10. Means for applying treating liquor to open-width moving substrate as defined in claim 7 wherein sensors are provided for sensing the locations of said edges and apparatus controlled by said sensors is provided for automatically positioning said sealing members for said underlapping to a predetermined extent.

11. Means for applying treating liquor to open-width moving substrate as defined in claim 5 wherein said continuing portion of said foam distribution chamber extends upwardly from said collecting means for draining from said continuing section decayed foam therein.

12. Means for applying treating liquor to open-width moving substrate as defined in claim 1, 5 or 11 wherein an automatic drain is provided at said distribution chamber for draining from said distribution chamber decayed foam therein.

13. Means for applying treating liquor to open-width moving substrate as defined in claim 1, 5 or 11 wherein said conduit means is disposed to feed said treating liquor in said foamed condition to said distribution chamber symmetrically with respect to the open width of said substrate.

14. Means for applying treating liquor to open-width moving substrate as defined in claim 1 or 5 wherein valve means is provided for allowing treating liquor foam to be discharged from said distribution chamber for recovery whenever substrate application is not desired.

15. Means for applying treating liquor to open-width moving substrate as defined in claim 5 wherein said application portion includes a slot for passage of said foamed liquor therethrough disposed for said traverse by said substrate, said slot having a length generally corresponding to the open width of said substrate and disposed thereacross, and means for varying said passage of said foamed liquor through said slot selectively along its length.

16. Means for applying treating liquor to open-width moving substrate as defined in claim 15 wherein said means for said varying said passage of said foamed liquor through said slot comprises throttling means disposed across the width of said distribution chamber and having means for positioning said throttling means for selective lateral protrusion thereof into said distribution chamber.

17. Means for applying treating liquor to open-width moving substrate as defined in claim 1 wherein means is disposed opposite said application portion for holding said moving substrate independently of tension therein in suitably uniform disposition to said application portion during said traverse thereat and for releasing air through said substrate incident to application of said foamed treating liquor.

18. Means for applying treating liquor to open-width moving substrate as defined in claim 17 wherein said substrate is porous, said application portion includes a slot for passage of said foamed liquor therethrough disposed for said traverse by said substrate and having a suitable width adjacent said substrate in the direction of movement thereof for said applying treating liquor to said substrate in even fashion, and said holding and releasing means comprises a platen generally coextensive with the cross-sectional area of said slot adjacent said substrate, said platen presenting a limited area of contacting surface suitably disposed to said substrate for maintaining said uniform disposition to said application portion and a suitable open area suitably disposed to said substrate for said releasing air thereat generally through the thickness of said substrate perpendicular to the flatwise extent of said substrate.

19. Means for applying treating liquor to open-width moving substrate as defined in claim 18 wherein said platen is suitably shaped adjacent said contacting surface area for working back into said substrate any foam appearing on said substrate within said open area.

20. In treating liquor application apparatus having an application portion where air blows treating liquor through a moving porous substrate traversing therepast for even and penetrating yet light treating liquor application, the improvement comprising means disposed opposite said application portion for holding said moving substrate independently of tension therein in suitably uniform disposition to said application portion during said traversing and for releasing said air thereat through said substrate incident to application of said treating liquor, said holding and releasing means comprising a platen generally coextensive with the area where said air blows through said substrate, said platen presenting a limited area of contacting surface suitably disposed to said substrate for maintaining said uniform disposition to said application portion and a suitable open area suitably disposed to said substrate for said releasing air thereat through the thickness of said substrate generally perpendicular to the flatwise extent of said substrate, and said platen being suitably shaped adjacent said contacting surface area for working back into said substrate any treating liquor appearing on said substrate within said open area.

21. Means for applying treating liquor to open-width moving substrate as defined in clim 5 or 20 wherein said platen comprises a plurality of elongated members in spaced parallel disposition to each other and to said application portion, said contacting surface of said platen being formed by generally cylindrical surfaces of said elongated members.

* * * * *